US006299705B1

(12) United States Patent
Nishimura et al.

(10) Patent No.: US 6,299,705 B1
(45) Date of Patent: Oct. 9, 2001

(54) HIGH-STRENGTH HEAT-RESISTANT STEEL AND PROCESS FOR PRODUCING HIGH-STRENGTH HEAT-RESISTANT STEEL

(75) Inventors: Nobuhiko Nishimura; Masahiro Umata; Masashi Ozaki, all of Nagasaki (JP)

(73) Assignee: Mitsubishi Heavy Industries, Ltd., Tokyo (JP)

( * ) Notice: Subject to any disclaimer, the term of this patent is extended or adjusted under 35 U.S.C. 154(b) by 0 days.

(21) Appl. No.: 09/397,518

(22) Filed: Sep. 17, 1999

(30) Foreign Application Priority Data

Sep. 25, 1998 (JP) ..... 10-272202

(51) Int. Cl.[7] ..... C22C 38/12; C22C 38/24; C22C 38/04; C21D 8/00

(52) U.S. Cl. ..... 148/328; 148/333; 148/654

(58) Field of Search ..... 148/320, 330, 148/333, 334, 654, 328; 420/127

(56) References Cited

U.S. PATENT DOCUMENTS 3,994,754 * 11/1976 Geymond ..... 148/335
5,382,307 * 1/1995 Kageyama et al. ..... 148/584
5,879,474 * 3/1999 Bhadeshia et al. ..... 148/333

FOREIGN PATENT DOCUMENTS 196 28 715 11/1997 (DE) .
2 101 014 1/1983 (GB) .
7-150245 6/1995 (JP) .
10-147835 6/1998 (JP) .

OTHER PUBLICATIONS

G.A. Chadwick, Solid–State Transformations, pp. 232–237, "Metallography of Phase Transformations," 1972.

* cited by examiner

*Primary Examiner*—Deborah Yee
(74) *Attorney, Agent, or Firm*—Oblon, Spivak, McClelland, Maier & Neustadt, P.C.

(57) ABSTRACT

An object is to provide a heat-resistant steel which can be produced at a low cost but possesses an excellent high-temperature strength. A high-strength heat-resistant steel is provided which comprises C in an amount of 0.06 to 0.15% by weight, Si in an amount of 1.5% by weight or less, Mn in an amount of 0.5 to 1.5% by weight, V in an amount of 0.05 to 0.3% by weight, and at least one of Nb, Ti, Ta, Hf, and Zr, in an amount of 0.01 to 0.1% by weight, the balance being Fe and unavoidable impurities, wherein the high-strength heat-resistant steel has a structure consisting mainly of a bainite structure.

15 Claims, No Drawings

HIGH-STRENGTH HEAT-RESISTANT STEEL AND PROCESS FOR PRODUCING HIGH-STRENGTH HEAT-RESISTANT STEEL

BACKGROUND OF THE INVENTION

1. Field of the Invention

The present invention relates to high-strength heat-resistant steels, and particularly to high-strength heat-resistant steels which are suitable for use in a medium-to-high temperature range up to 540° C., and which can be produced at a low cost.

This application is based on Patent Applications Nos. Hei 10-272202 and Hei 11-40618, both filed in Japan, the contents of which are incorporated herein by reference.

2. Description of Related Art

Large portions of materials for pressure-tight parts of piping for use in the highest temperature sections of subcritical-pressure boilers and supercritical-pressure boilers in power plants and waste heat recovery boilers in combined cycle power plants, and semi-high temperature sections of ultra supercritical-pressure boilers are carbon steels and low alloy steels such as 1 Cr steel and 2 Cr steel.

Specific examples of low alloy steels which have been used are 0.5 Mo steel (JIS STBA 12), 1 Cr—0.5 Mo steel (JIS KA STBA 21, STBA 22, STBA 23) and 2.25 Cr—1 Mo steel (JIS STBA 24).

Since large portions of the materials for pressure-tight parts of piping are carbon steels and low alloy steels such as 1Cr steel and 2Cr steel, achievement of sufficient strength of the materials for the parts in which they are used, without increasing the use of alloying elements, would largely contribute to reducing the cost for constructing a power plant.

In Japanese Unexamined Patent Application, First Publication (Kokai) No. Hei 10-195593, the present inventors proposed a steel excellent in high-temperature strength as a material suitable for the above uses, comprising C in an amount of 0.01 to 0.1% by weight, Si in an amount of 0.15 to 0.5% by weight, Mn in an amount of 0.4 to 2% by weight, V in an amount of 0.01 to 0.3% by weight, and Nb in an amount of 0.01 to 0.1% by weight, the balance being Fe and unavoidable impurities.

The heat-resistant steel proposed as above is a useful steel, which possesses an enhanced high-temperature strength in comparison with conventional steels although it can be produced at a low cost. However, further enhancement of the high-temperature strength is desired without increasing the cost.

BRIEF SUMMARY OF THE INVENTION

An object of the present invention is to provide a heat-resistant steel which can be produced at a low cost but possesses excellent high-temperature strength, and to provide a production process therefor. Another object of the present invention is to provide a process for producing such a heat-resistant steel possessing excellent high-temperature strength at a low cost by simplified production steps.

In order to achieve the above objects, the following technical measures were taken. That is, the present invention provides a high-strength heat-resistant steel comprising C in an amount of 0.06 to 0.15% by weight, Si in an amount of 1.5% by weight or less, Mn in an amount of 0.5 to 1.5% by weight, V in an amount of 0.05 to 0.3% by weight, and at least one of Nb, Ti, Ta, Hf, and Zr, in an amount of 0.01 to 0.1% by weight, the balance being Fe and unavoidable impurities, wherein the high-strength heat-resistant steel has a structure consisting mainly of a bainite structure.

The high-strength heat-resistant steel according to the present invention, although it contains a small amount of alloying elements, possesses an excellent creep rupture strength, such as 130 MPa extrapolated to $10^4$ hours at 550° C., due to a structure consisting mainly of a bainite structure, or preferably consisting of a bainite single-phase structure.

It is preferable that the Si be present in an amount of 0.6% by weight or greater in the high-strength heat-resistant steel according to the present invention if oxidation resistance is regarded as important. The high-strength heat-resistant steel according to the present invention may further comprise at least one of Cr, in an amount of 0.7% by weight or less, and Mo, in an amount of 0.7% by weight or less. The high-strength heat-resistant steel according to the present invention may further comprise B in an amount of 0.005% by weight or less.

The above high-strength heat-resistant steel can be produced by a process for producing a high-strength heat-resistant steel, the process comprising the steps of: normalizing the steel at a temperature in the range of 1100 to 1250° C., the steel comprising C in an amount of 0.06 to 0.15% by weight, Si in an amount of 1.5% by weight or less, Mn in an amount of 0.5 to 1.5% by weight, V in an amount of 0.05 to 0.3% by weight, and at least one of Nb, Ti, Ta, Hf, and Zr, in an amount of 0.01 to 0.1% by weight, the balance being Fe and unavoidable impurities; hot-working the steel at a final reduction ratio of 50% or greater at a temperature within the range in which austenite recrystallizes, so as to produce a hot-worked product; and cooling the hot-worked product to room temperature or to a temperature lower than the temperature at which the transformation to bainite is completed.

Alternatively, the above high-strength heat-resistant steel can be produced by a process comprising the steps of: preparing an ingot having the above composition; hot-working the ingot, during the process of cooling the ingot, at a final reduction ratio of 50% or greater at a temperature within the range in which austenite recrystallizes, so as to produce a hot-worked product; and cooling the hot-worked product to room temperature or to a temperature lower than the temperature at which the transformation to bainite is completed.

In the above processes of the present invention, after the step of hot-working at a temperature within the range in which austenite recrystallizes, the hot-worked product may be additionally hot-worked at a temperature in the range of 950° C. to the $Ar_3$ point, and then the step of cooling the hot-worked product to room temperature or to a temperature lower than the temperature at which the transformation to bainite is completed may be conducted. Moreover, after the step of cooling to room temperature or to a temperature lower than the temperature at which the transformation to bainite is completed to produce a cooled product, the step of tempering the cooled product at the $A_1$ point or a lower temperature may be conducted.

When a high-strength heat-resistant pipe is produced according to the present invention, the process may comprise the steps of: normalizing a steel having the above composition at a temperature in the range of 1100 to 1250° C.; piercing the steel to produce a pierced product; and cooling the pierced product to room temperature or to a temperature lower than the temperature at which the transformation to bainite is completed. Alternatively, the process may comprise the steps of: preparing an ingot having the above composition; piercing the ingot, during the process of cooling the ingot, at a temperature within the range in which austenite recrystallizes, so as to produce a pierced product; and cooling the pierced product to room temperature or to a temperature lower than the temperature at which the transformation to bainite is completed.

The effects of the present invention are explained in the following.

The heat-resistant steel according to the present invention, although it is a low alloy, possesses a creep rupture strength superior to those of conventional heat-resistant steels, due to its specific chemical composition and a structure consisting mainly of a bainite structure. Accordingly, this effect can be made more remarkable by making the structure a single-phase structure. In the present invention, a prescribed amount of at least one of Cr and Mo, which may be incorporated, improves the hardenability, and contributes to the formation of the single-phase bainite structure. In addition, B improves the hardenability by restricting the generation of ferrite, and contributes to the formation of the single-phase bainite structure.

The production process of the present invention, according to which a steel of a specific composition is normalized at a temperature in the range of 1100 to 1250° C., then hot-worked at a final reduction ratio of 50% or higher at a temperature within the range in which austenite recrystallizes, and then cooled to room temperature or to a temperature lower than the temperature at which the transformation to bainite is completed, allows production of a high-strength heat-resistant steel, having a structure consisting mainly of a bainite structure, which, although it is a low alloy, possesses a creep rupture strength superior to those of conventional heat-resistant steels.

The other production process, according to which an ingot of specific composition is prepared, then hot-worked, during the process of cooling the ingot, at a final reduction ratio of 50% or greater at a temperature within the range in which austenite recrystallizes, and then cooled to room temperature or to a temperature lower than the temperature at which the transformation to bainite is completed, allows production of a high-strength heat-resistant steel which possesses a creep rupture strength superior to those of conventional heat-resistant steels at a low cost in a simplified production process.

In the case in which a pipe such as a boiler tube is manufactured, piercing may take place at a temperature within the range in which austenite recrystallizes, and then cooling to room temperature or to a temperature lower than the temperature at which the transformation to bainite is completed. This production process allows production of a high-strength heat-resistant pipe which, although it is a low alloy, possesses a creep rupture strength superior to those of conventional heat-resistant pipes.

DETAILED DESCRIPTION OF THE INVENTION

The present invention will be described further in detail below. Amounts of the components are expressed on the basis of weight percentages, unless otherwise specified.

First, the reasons for defining the above ranges of amounts of the components are described below.

C (carbon) combines with V, Nb, or the like to form a fine carbide, thereby securing the high-temperature strength and improving the hardenability. According to the present invention, the C content is at least 0.06% in order to achieve these effects. However, since an excessive amount of C would degrade the weldability, the C content is limited to up to 0.15%. A preferable C content is 0.08 to 0.12%.

Si (silicon) is an element necessary as a deoxidizer in steel production, and the Si content is set to be 1.5% or less. Si is also an element effective in enhancing the oxidation resistance. When Si is used in expectation of this effect, a preferable Si content is 0.6% or higher.

Mn (manganese) is an element necessary as a deoxidizer in steel production, as Si is. In addition, Mn is incorporated according to the present invention for the purpose of forming the bainite structure. In order to achieve these effects, at least 0.5% of Mn content is required. However, since a Mn content exceeding 1.5 results in decreasing in the $A_1$ point, it is limited to up to 1.54%. A preferable Mn content is 0.8 to 1.2%, in the range of which a particularly excellent creep rupture strength can be achieved.

V (vanadium) combines with C to form a NaCl-type carbide. This fine carbide is very stable even at a high temperature, and enhances the high-temperature strength by inhibiting movements of dislocation. According to the present invention, the V content is at least 0.05% in order to achieve this effect. However, since a V content exceeding 0.3% does not result in imparting a comparable effect, the V content is limited to up to 0.3%. A preferable V content is 0.15 to 0.25%.

At least one of Nb (niobium), Ti (titanium), Ta (tantalum), Hf (hafnium), and Zr (zirconium) forms a NaCl-type carbide, as V does. However, unlike V, since the solid solubilities of Nb, Ti, Ta, Hf, and Zr in the $\gamma$ range are extremely small, bulky carbides precipitated during the cooling process after dissolution and during hot-forging, such as NbC, remain after normalization at a temperature less than 1100° C. without being dissolved. Such bulky carbides do not contribute to the enhancement of the high-temperature strength. Therefore, according to the present invention, the temperature for the normalization is set at 1100° C. or higher to dissolve carbides such as NbC, and then fine carbides are precipitated. This feature will be described further in detail later.

Cr (chromium) and Mo (molybdenum) function to improve the homogeneity of the structure to enhance the ductility. In addition, since Cr and Mo also function to improve the hardenability, incorporation of Cr or Mo allows the bainite structure to be easily obtained even when the amount of Cr or Mn is reduced. Furthermore, since Cr forms a Cr-type carbide and since Mo is dissolved in the matrix phase, both Cr and Mo are effective in enhancing the creep rupture strength. However, since either Cr or Mo exceeding 0.7% would increase the cost, which is inconsistent with the purpose of the present invention, the content of each of Cr and Mo is determined to be 0.7% or less. It is preferable that at least one of Cr, in an amount of 0.3 to 0.7%, and Mo, in an amount of 0.3 to 0.7%, be contained.

B (boron) restricts the generation of ferrite, and improves the hardenability. Accordingly, incorporation of B allows the bainite structure to be easily obtained even when the amount of C or Mn is reduced. However, an excessive amount of B would result in reduction in the toughness and the ductility due to formation of a boride. Accordingly, the B content is determined to be 0.005% or less.

Next, the production process will be described.

A remarkable feature of the production process according to the present invention is that the normalization process is conducted at a high temperature in the range of 1100 to 1250° C. That is, although this type of heat-resistant steel has been conventionally normalized at a temperature lower than 1100° C., the normalization process according to the present invention is conducted at a temperature of 1100° C. or higher in order to allow NbC and other elements to be thoroughly dissolved. Improvement in the hardenability due to this high-temperature normalization results in formation of the bainite structure and enhancement of the high-temperature strength. However, since a temperature exceeding 1250° C. would result in formation of considerably bulky crystal grains, the temperature of the normalization is determined to be 1250° C. or lower. A preferable temperature of the normalization is 1150 to 1200° C. The temperature of the normalization does not have to be maintained at a constant level, but may vary as long as it is within the above range.

According to the present invention, after the above normalization process, a hot-working process is performed at a temperature within the range (γ) in which austenite recrystallizes. The hot-working promotes the recrystallization to allow formation of fine crystal grains, and allows carbides such as NbC to uniformly and finely precipitate in the crystal grains. Because of this fine bainite structure, the heat-resistant steel according to the present invention possesses a high strength.

The working temperature may vary depending on the composition of the steel; however, a temperature of approximately 950° C. or higher can achieve the purpose of the hot-working. The reduction ratio of the hot-working should be 50% or greater. This is because a reduction ratio smaller than 50% would result in insufficient achievement of the above effects. A preferable reduction ratio is 70% or greater. The hot-working is normally carried out as hot-rolling.

After the above hot-working, a finish hot-working (or rolling) may be carried out in which finishing (or rolling) may be carried out at a temperature in the range of 950° C. to the $Ar_3$ point. The desired thickness of a sheet or dimensions of a pipe can be obtained by the finishing process.

After the completion of the hot-working process, the matrix phase structure of the steel is transformed to the bainite structure by air-cooling or forced cooling to room temperature or to a temperature lower than the temperature at which the transformation to bainite is completed, so as to accomplish dislocation hardening.

After the cooling process, the steel may be tempered at the $A_1$ point or a lower temperature. A preferable range of the tempering temperature is (the temperature of the $A_1$ point)−50° C. to the temperature of the $A_1$ point.

The above production process is established on the basis of the assumption that an ingot of specific composition is prepared, a sheet is formed by subjecting the ingot to a hot-forging process or the like, and the sheet is once cooled, then heated to a specific temperature, then normalized, and then hot-worked. However, the high-strength heat-resistant steel of the present invention may be obtained by a process, which is not limited to the above process, in which, for example, an ingot is prepared, the ingot is hot-worked, during the process of cooling the ingot, at a temperature within the range in which austenite recrystallizes, and then the hot-worked product is cooled to a specific temperature. That is, the ingot under the condition in which carbides and other elements are dissolved, is subjected to the hot-working process at a temperature within the range in which austenite recrystallizes so as to obtain effects similar to those obtained by the above production process according to the present invention. According to this production process, since a desired steel can be obtained directly from the ingot without undergoing reheating for forging and normalization, simplification of the production steps and reduction of the production cost can be achieved.

When a pipe such as a boiler tube is produced according to the present invention, a piercing process can be conducted instead of the hot-working process conducted at a temperature within the range in which austenite recrystallizes in the above production process of the present invention. This piercing process has the same function as that of the hot-working process, and allows the obtained heat-resistant steel to have a high strength. Specific examples of the piercing process are a tilting piercing method, a mandrel mill method, and a hot extrusion method.

Embodiments

The high-strength heat-resistant steel according to the present invention will be described by way of examples below.

Each of the steels having the chemical compositions as shown in Table 1 was fused in a vacuum, and then hot-forged to produce a sheet having a thickness of 20 mm. Thereafter, the sheet was normalized by heating at 1200° C. for 20 minutes, hot-rolled at a final reduction ratio of 40% at 1000° C., and then air-cooled to room temperature. However, only Sample No. 15 in Table 1 was normalized at 1100° C.

In Table 1, Sample Nos. 1 to 14 are examples according to which the compositions and the temperatures for normalization are within the range of the present invention, Sample No. 15 is an example according to which the composition is within the range of the present invention but the temperature for normalization is outside the range of the present invention, and Sample Nos. 16 to 19 are examples according to which the compositions and the temperatures for normalization are outside the range of the present invention.

Microstructures of the samples obtained were inspected, and the creep rupture strength extrapolated to $10^4$ hours at 550° C., elongation, reduction of area, and oxidation resistance of each sample were evaluated. The results are shown in Table 2. The oxidation resistance was evaluated by measuring an average thickness of the oxided scales formed at 550° C. over a period of 3000 hours.

TABLE 1

| | Sample No. | C | Si | Mn | V | Nb | Others | Fe | Normalization Temperature |
|---|---|---|---|---|---|---|---|---|---|
| Present Invention | 1 | 0.09 | 0.40 | 1.05 | 0.194 | 0.012 | | Bal. | 1200° C. |
| | 2 | 0.10 | 0.34 | 1.10 | 0.191 | 0.023 | | Bal. | 1200° C. |
| | 3 | 0.10 | 0.33 | 1.08 | 0.192 | 0.053 | | Bal. | 1200° C. |
| | 4 | 0.11 | 0.29 | 1.09 | 0.185 | 0.083 | | Bal. | 1200° C. |
| | 5 | 0.10 | 0.33 | 0.65 | 0.191 | 0.055 | | Bal. | 1200° C. |
| | 6 | 0.10 | 0.34 | 1.43 | 0.21 | 00.51 | | Bal. | 1200° C. |
| | 7 | 0.11 | 0.87 | 0.96 | 0.079 | 0.059 | | Bal. | 1200° C. |

TABLE 1-continued

| | Sample No. | C | Si | Mn | V | Nb | Others | Fe | Normalization Temperature |
|---|---|---|---|---|---|---|---|---|---|
| | 8 | 0.11 | 0.35 | 1.08 | 0.251 | 0.058 | B: 0.0032 | Bal. | 1200° C. |
| | 9 | 0.10 | 1.15 | 1.12 | 0.213 | 0.052 | Mo: 0.25 | Bal. | 1200° C. |
| | 10 | 0.14 | 0.35 | 0.91 | 0.236 | 0.048 | Cr: 0.35 | Bal. | 1200° C. |
| | 11 | 0.12 | 0.33 | 1.12 | 0.089 | — | Ti: 0.061 | Bal. | 1200° C. |
| | 12 | 0.10 | 0.40 | 1.03 | 0.185 | — | Ta: 0.070 | Bal. | 1200° C. |
| | 13 | 0.11 | 0.29 | 1.30 | 0.165 | — | Zr: 0.39 | Bal. | 1200° C. |
| | 14 | 0.11 | 0.26 | 1.10 | 0.155 | — | Hf: 0.095 | Bal. | 1200° C. |
| Comparative Examples | 15 | 0.09 | 0.40 | 1.05 | 0.194 | 0.012 | | Bal. | 1100° C. |
| | 16 | 0.12 | 0.31 | 1.46 | 0.195 | 0.001 | | Bal. | 1200° C. |
| | 17 | 0.10 | 0.31 | 0.40 | 0.173 | 0.041 | | Bal. | 1200° C. |
| | 18 | 0.15 | 0.35 | 1.65 | 0.193 | 0.080 | | Bal. | 1200° C. |
| | 19 | 0.11 | 0.33 | 1.42 | 0.021 | 0.055 | | Bal. | 1200° C. |

TABLE 2

| | Sample No. | Matrix phase structure | Average grain size (μm) | Creep rupture strength (MPa) | Elongation (%) | Reduction of area (%) | Oxidation resistance (μm) |
|---|---|---|---|---|---|---|---|
| Present Invention | 1 | B single | 50 | 144 | 35 | 82 | 60 |
| | 2 | B single | 52 | 148 | 38 | 81 | 62 |
| | 3 | B single | 48 | 152 | 32 | 84 | 61 |
| | 4 | B single | 45 | 153 | 33 | 83 | 63 |
| | 5 | B + α multi | 43 | 132 | 41 | 89 | 65 |
| | 6 | B single | 52 | 140 | 39 | 88 | 57 |
| | 7 | B single | 47 | 133 | 41 | 89 | 62 |
| | 8 | B single | 55 | 155 | 33 | 82 | 63 |
| | 9 | B single | 51 | 158 | 32 | 83 | 55 |
| | 10 | B single | 42 | 158 | 33 | 80 | 59 |
| | 11 | B single | 56 | 136 | 40 | 87 | 61 |
| | 12 | B single | 51 | 150 | 34 | 85 | 63 |
| | 13 | B single | 46 | 145 | 37 | 86 | 62 |
| | 14 | B single | 44 | 146 | 37 | 86 | 61 |
| Comparative Examples | 15 | α single | 51 | 125 | 46 | 91 | 63 |
| | 16 | B single | 52 | 140 | 42 | 93 | 62 |
| | 17 | α + B multi | 48 | 129 | 45 | 92 | 61 |
| | 18 | B single | 46 | 140 | 39 | 88 | 65 |
| | 19 | B single | 50 | 115 | 42 | 89 | 65 |

Microstructures:
"B single" = bainite single-phase structure
"B + α multi" = multi-phase structure comprising bainite and a small amount of ferrite
"α single" = ferrite single-phase structure
"α + B multi" = multi-phase structure comprising ferrite and a small amount of bainite The matrix phase of each of Sample Nos. 1 to 14 according to th present invention has a single-phase bainite structure or a multi-phase structure comprising a bainite structure as a main structure and a small amount of ferrite. The average crystal gain size is several tens of micrometers. Fine NaCl-type carbides having an average grain size of several tens of nanometers are uniformly dispersed.

Sample No. 15, of which the steel composition is within the range of the present invention but the temperature for normalization is 1100° C., which is lower than that for the present invention, has a structure comprising a matrix phase which is a ferrite single phase and fine NaCl-type carbides having an average grain size of several tens of nanometers dispersed in the matrix phase.

The reason why each matrix phase of Sample Nos. 1 to 14 according to the present invention is a single-phase bainite structure or a multi-phase structure comprising a bainite structure as a main structure and a small amount of ferrite whereas the matrix phase of Sample No. 15 is a ferrite single-phase structure is because there are differences in the temperatures of the normalization. That is, the reason is because the normalization process at a high temperature such as 1100° C. or higher as conducted for Sample Nos. 1 and 3 to 12 according to the present invention allowed thorough solid dissolution of NbC and other elements and thus improved the hardenability.

Sample No. 17, which contains less Mn, which is an element forming the bainite structure, than the present invention defines, has a multi-phase structure comprising ferrite as a main structure and a small amount of bainite. Therefore, in order to make the matrix phase have a bainite structure as a main structure, the Mn content needs to be 0.5% or higher.

The results with regard to Sample Nos. 1 to 4 and 16 in Tables 1 and 2 reveal that the creep rupture strength increases as the Nb content increases, but the creep rupture strength tends to approach a constant level when the Nb content exceeds 0.05%. Accordingly, a preferable Nb content is approximately 0.05%.

Furthermore, the results with regard to Sample Nos. 3, 5, 6, 17, and 18 in Tables 1 and 2 reveal that the creep rupture strength increases as the Mn content increases, but the creep rupture strength reaches a peak at a Mn content around 1.0%, exceeding which the creep rupture strength decreases. Accordingly, a preferable Mn content is approximately 1.0%.

Moreover, the results with regard to Sample Nos. 3, 7, 8, and 19 in Tables 1 and 2 reveal that the creep rupture strength increases as the V content increases, but the increase of the creep rupture strength is most marked at a V content around 0.2%, exceeding which improvement in the creep rupture strength is not comparable to the cost of the additional V. Accordingly, a preferable V content is approximately 0.2%.

Sample No. 15 is an example in which a low normalization temperature such as 1100° C. resulted in forming a matrix phase which is a ferrite single phase, although the steel composition was the same as that of Sample No. 1. The creep rupture strength of Sample No. 15 is evidently inferior to that of Sample No. 1.

With regard to the oxidation resistance, Sample Nos. 7 and 10 have improved oxidation resistance in comparison with the other samples. This is assumed to be because Sample Nos. 7 and 10 contain more Si than the other samples.

Next, an ingot having the composition of Sample No. 3 was prepared, and the ingot was hot-worked, during the process of cooling the ingot, at a temperature within the range in which austenite recrystallizes, and then cooled to room temperature. Thereafter, the microstructure was inspected, and was found to have a structure in which NbC grains having an average grain size of several tens of nanometers were uniformly dispersed in the matrix which was a bainite single phase. The creep rupture strength extrapolated to $10^4$ hours at 550° C. was evaluated to be 152 MPa.

In addition, an ingot having the composition of Sample No. 3 was prepared, and the ingot was pierced, during the process of cooling the ingot, at a temperature within the range in which austenite recrystallizes, and then cooled to room temperature. Thereafter, the microstructure was inspected, and was found to have a structure in which NbC grains having an average grain size of several tens of nanometers were uniformly dispersed in the matrix which was a bainite single phase. The creep rupture strength extrapolated to $10^4$ hours at 550° C. was evaluated to be 152 MPa.

As demonstrated above, since high-temperature strength can be secured by conducting the hot-working or piercing process at a temperature within the range in which austenite recrystallizes directly after the forging process, the production process according to the present invention contributes to simplification of the production steps and reduction of the production cost.

Furthermore, an ingot having the composition of Sample No. 3 was prepared, and the ingot was hot-forged to produce a sheet having a thickness of 20 mm. Thereafter, a normalization process by heating at 1200° C. for 20 minutes, a hot-rolling process at a final reduction ratio of 40% at 1000° C., and a finish hot-rolling process at a final reduction ratio of 50% at 950° C. were conducted, and the sheet was cooled to room temperature and then tempered by heating at 650° C. for 30 minutes. Thereafter, the microstructure was inspected, and was found to have a structure in which NbC grains having an average grain size of several tens of nanometers were uniformly dispersed in the matrix which was a bainite single phase. The creep rupture strength extrapolated to $10^4$ hours at 550° C. was evaluated to be 152 MPa.

What is claimed is:

1. A high-strength heat-resistant steel comprising:

C in an amount greater than 0.06% by weight and not greater than 0.15% by weight, Si in an amount of 1.5% by weight or less, Mn in an amount of 0.5 to 1.5% by weight, V in an amount of 0.05 to 0.3% by weight, Cr in an amount greater than 0% by weight and not greater than 0.7% by weight, and at least one of Nb, Ti, Ta, Hf, and Zr, in an amount of 0.01 to 0.1% by weight, the balance being Fe and unavoidable impurities, wherein the high-strength heat-resistant steel has a structure that consists of bainite, and that includes at least one carbide of V, Nb, Ti, Ta, Hf or Zr.

2. A high-strength heat-resistant steel comprising:

C in an amount of 0.06 to 0.15% by weight,

Si in an amount of 0.6 to 1.5% by weight,

Mn in an amount of 0.5 to 1.5% by weight,

V in an amount of 0.05 to 0.3% by weight, and at least one of Nb, Ti, Ta, Hf, and Zr, in an amount of 0.01 to 0.1% by weight, the balance being Fe and unavoidable impurities, wherein the high-strength heat-resistant steel has a structure that consists mainly of a bainite structure, and that includes at least one carbide of V, Nb, Ti, Ta, Hf or Zr.

3. A high-strength heat-resistant steel according to claim 1, which has a creep rupture strength, extrapolated to $10^4$ hours at 550° C., of at least 130 MPa.

4. A high-strength heat-resistant steel according to claim 1, which further comprises Mo in an amount of 0.7% by weight or less.

5. A high-strength heat-resistant steel according to claim 1, which further comprises B in an amount of 0.005% by weight or less.

6. A process for producing a high-strength heat-resistant steel, the process comprising the steps of:

normalizing a steel at a temperature in the range of 1100 to 1250° C., the steel comprising C in an amount of 0.06 to 0.15% by weight, Si in an amount of 0.6 to 1.5% by weight, Mn in an amount of 0.5 to 1.5% by weight, V in an amount of 0.05 to 0.3% by weight, and at least one of Nb, Ti, Ta, Hf, and Zr, in an amount of 0.01 to 0.1% by weight, the balance being Fe and unavoidable impurities, hot-working the steel at a final reduction ratio of 50% or greater at a temperature within the range in which austenite recrystallizes, so as to produce a hot-worked product, cooling the hot-worked product to room temperature or to a temperature lower than the temperature at which transformation to bainite is completed, and forming the steel of claim 2.

7. A process for producing a high-strength heat-resistant steel, the process comprising the steps of:

preparing an ingot comprising C in an amount of 0.06 to 0.15% by weight, Si in an amount of 0.6 to 1.5% by weight, Mn in an amount of 0.5 to 1.5% by weight, V in an amount of 0.05 to 0.3% by weight, and at least one of Nb, Ti, Ta, Hf, and Zr, in an amount of 0.01 to 0.1% by weight, the balance being Fe and unavoidable impurities, hot-working the ingot, during a process of cooling the ingot, at a final reduction ratio of 50% or greater at a temperature within the range in which austenite recrystallizes, so as to produce a hot-worked product, cooling the hot-worked product to room temperature or to a temperature lower than the temperature at which transformation to bainite is completed, and forming the steel of claim 2.

8. A process for producing a high-strength heat-resistant steel according to claim 6, wherein, after the step of hot-working, the process further comprises the step of additionally hot-working the hot-worked product at a temperature in the range of 950° C. to the $Ar_3$ point.

9. A process for producing a high-strength heat-resistant steel according to claim 7, wherein, after the step of hot-working, the process further comprises the step of additionally hot-working the hot-worked product at a temperature in the range of 950° C. to the $Ar_3$ point.

10. A process for producing a high-strength heat-resistant steel according to claim 6, wherein, after the step of cooling to produce a cooled product, the process further comprises the step of tempering the cooled product at the $A_1$ point or a lower temperature.

11. A process for producing a high-strength heat-resistant steel according to claim 7, wherein, after the step of cooling to produce a cooled product, the process further comprises the step of tempering the cooled product at the $A_1$ point or a lower temperature.

12. A high-strength heat-resistant steel according to claim 1, wherein the C is in an amount of 0.08 to 0.15% by weight.

13. A high-strength heat-resistant steel according to claim 1, wherein the Cr is in an amount of 0.3 to 0.7% by weight.

14. A high-strength heat-resistant steel according to claim 1, wherein the C is in an amount of greater than 0.06% by weight to 0.12% by weight.

15. A high-strength heat-resistant steel according to claim 2, wherein the C is in an amount of 0.06 to 0.12% by weight.

* * * * *